United States Patent [19]

Garrod

[11] Patent Number: 4,754,795

[45] Date of Patent: Jul. 5, 1988

[54] SHUTTER

[75] Inventor: David H. Garrod, Bingley, United Kingdom

[73] Assignee: Bolton Brady Limited, Bradford, United Kingdom

[21] Appl. No.: 944,505

[22] Filed: Dec. 19, 1986

[30] Foreign Application Priority Data

Dec. 24, 1985 [GB] United Kingdom ..... 8531813

[51] Int. Cl.[4] ..... E06B 9/14

[52] U.S. Cl. ..... 160/133; 160/33

[58] Field of Search ..... 160/133, 26, 32, 33, 160/23 R

[56] References Cited

U.S. PATENT DOCUMENTS

| | | | |
|---|---|---|---|
| 1,585,270 | 5/1926 | Stevenson | 160/26 X |
| 1,621,717 | 3/1927 | Grant et al. | 160/26 X |
| 2,188,509 | 1/1940 | Kavanagh et al. | 160/271 |
| 2,934,139 | 4/1960 | Wardlaw et al. | 160/26 |
| 2,978,019 | 4/1961 | Carlo | 160/23 R |
| 3,090,424 | 5/1963 | Carlo | 160/23 R |
| 3,231,005 | 1/1966 | Cookson et al. | 160/133 X |
| 3,465,805 | 9/1969 | Lyman | 160/133 X |
| 3,490,514 | 1/1970 | Duncan et al. | 160/133 X |
| 3,522,834 | 8/1970 | Corcoran | 160/133 X |

FOREIGN PATENT DOCUMENTS 948720 2/1964 United Kingdom .

*Primary Examiner*—Ramon S. Britts
*Assistant Examiner*—David M. Purol
*Attorney, Agent, or Firm*—Mattern, Ware, Stoltz & Fressola

[57] ABSTRACT

A roller shutter is described which has a roller (13) arranged with its axis vertical, so that the shutter curtain (10) is extended laterally in use. The weight of the curtain (10) is supported in the extended condition from a top track (14) having internal running surfaces (35) co-operating with roller wheels (34) of a top chain (29), to which the articulated laths (11) of the curtain are, in turn, attached. Constant tensioning means (18–25) are provided for the curtain, which can follow a straight, angled or curving path. The bottom chain (9) of the curtain may have depending skirts (42), interfitting (at 43, 45) to reduce fire penetration. A lead-in guide (50) of the roller housing (12) has a lifting ramp (53) co-operating with ball glides (38) of the bottom chain to lift the curtain (10) gently onto, and off, the top track (14) running surfaces (35) on leaving and re-entering the housing (12).

13 Claims, 6 Drawing Sheets

SHUTTER

BACKGROUND OF THE INVENTION

1. Field of the Invention

This invention relates to a shutter.

It relates more specifically to a shutter of the type known as a "roller shutter" in which a shutter curtain made up of articulated laths is extended from a roller housing along a guide track, the shutter being extended by drive means, usually an electric motor.

2. Description of the Prior Art

Conventional shutter curtains used to cover an opening are withdrawn onto a roller having a generally horizontally disposed axis. In use, the shutter may be lowered in a more or less vertical direction from the roller to cover for example a shop window or door opening. Another form of shutter curtain is used as a fire barrier to cover an escalator and, in this case, it will be extended in a generally horizontal direction from the roller, which again has a horizontal axis.

However, difficulty arises when it is desired to cover for example a shop frontage having an irregular shape, perhaps including a curved portion or an inward recess or outwardly projecting window bay for example. At present, it is necessary to use a number of vertically opening shutters arranged edge to edge to approximate to the shape of such a frontage. Intermediate guide tracks need to be placed in vertical position to guide the edges of these discrete shutter curtains, separate drive means need to be provided for each shutter and the arrangement is expensive, clumsy and time consuming to operate.

Furthermore, there are limitations on the width of opening which can be covered by a single vertical shutter and substantial overhead clearance is required for the housing within which the shutter is rolled when not in use.

BRIEF SUMMARY OF THE INVENTION

It is an object of the present invention to provide a shutter which overcomes or reduces some or all of these disadvantages.

According to the invention there is provided a shutter comprising a roller; a shutter curtain adapted to be wound on said roller in a withdrawn condition and comprising a plurality of articulated laths; guide means for the curtain; and drive means adapted to cause the curtain to travel between the withdrawn condition and an extended condition in which it is unwound from the roller; characterised in that the roller is mounted with its axis vertical.

The guide means may be adapted to support the weight of the curtain in the extended condition.

Preferably, the guide means comprise a top track.

The guide means may additionally comprise a bottom track.

The roller may include resilient tensioning means for tensioning the curtain.

Preferably, the resilient tensioning means provide a substantially constant tensioning force on the curtain throughout its travel between the withdrawn and extended conditions. For example, the tensioning means may be of the type described and claimed in published British patent application No. 2,172,327.

Thus, the roller on which the curtain is to be wound includes an inner shaft and an outer tube with spring tensioning means fixed therebetween, the inner shaft being operatively connected to the drive mechanism whereby the spring means can be pretensioned by rotation of the outer tube relative to the inner shaft and, in operation, the tension between the outer tube and the inner shaft, and thereby on the curtain, remains substantially constant irrespective of the degree of opening or closing of the curtain.

The curtain may include upper and lower chains, each articulated lath being secured to a link of each of the chains.

The upper chain may include roller wheels adapted to located on running surface provided with the top track to at least partly support the weight of the curtain.

The lower chain may include low friction floor engaging means such as ball glides.

The roller may be provided within a housing adapted to house the entire curtain in the withdrawn condition.

The base of the housing may be provided internally with low friction support means for the weight of the curtain.

In the region where the curtain leaves the roller housing on being unwound, a lead-in guide may be provided to ensure that the curtain enters the guide means accurately.

The lead-in guide for the lower edge of the curtain may include a ramp adapted to lift the curtain slightly for smooth initial engagement of the roller wheels with the top track running surfaces.

BRIEF DESCRIPTION OF THE SEVERAL VIEWS OF THE DRAWINGS

A shutter embodying the invention will now be described in more detail by way of example only with reference to the accompanying drawings in which.

DETAILED DESCRIPTION OF AN EMBODIMENT OF THE INVENTION

Figure 1:
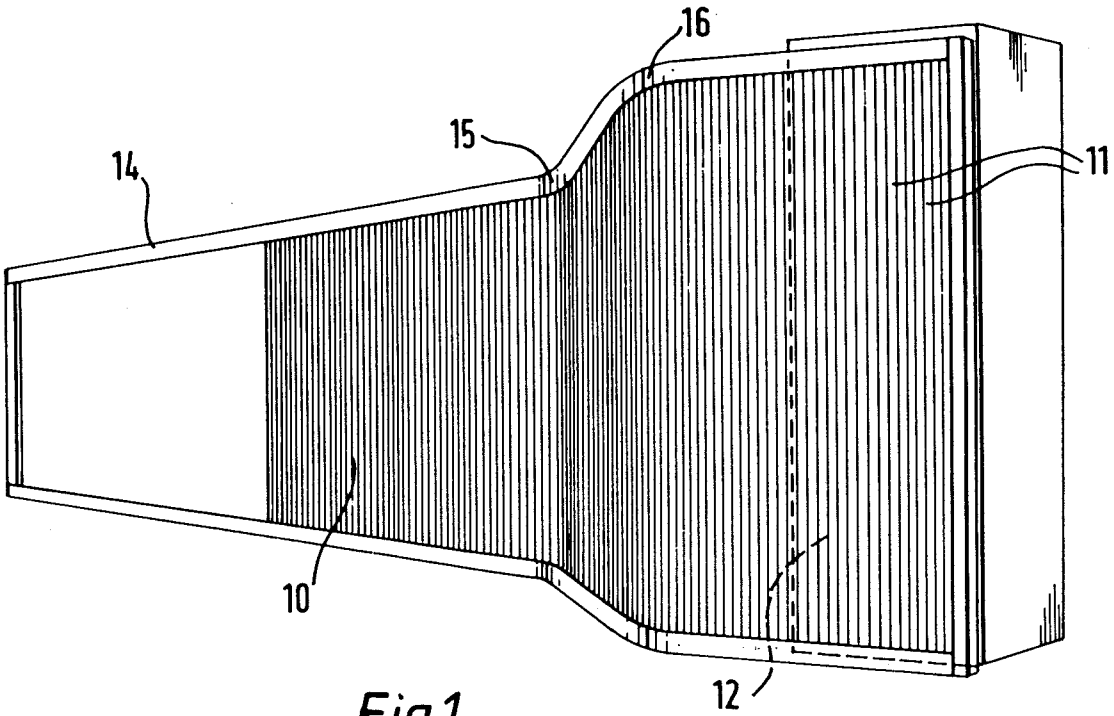
FIG. 1 is a diagrammatic perspective view of a shutter embodying the invention shown partly extended along a curved track.

Referring firstly to FIG. 1 of the drawings, a roller shutter includes a curtain 10 formed of a plurality of individual laths 11 which are articulated together in generally known manner. The laths are, in contrast to conventional roller shutter laths, arranged with their longitudinal axes vertical and are caused to wind and unwind from a housing 12 enclosing a roller 17 disposed with its axis vertical.

The curtain 10 can be housed entirely within the housing 12 in a withdrawn condition and can then be extended by power drive means to be described to an extended condition in which the upper edge of the curtain 10 is guided by a top track 14, which also carries the weight of the curtain 10. The top track 14 can be straight but in the example illustrated has both concave and convex bends 15 and 16.

Figure 2:
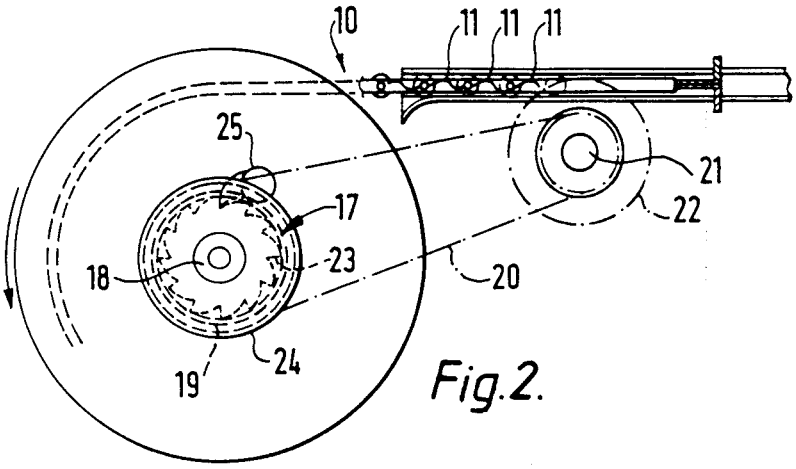
FIG. 2 is a top plan view of the shutter in the withdrawn condition, illustrating tensioning means for the curtain.
Figure 3:
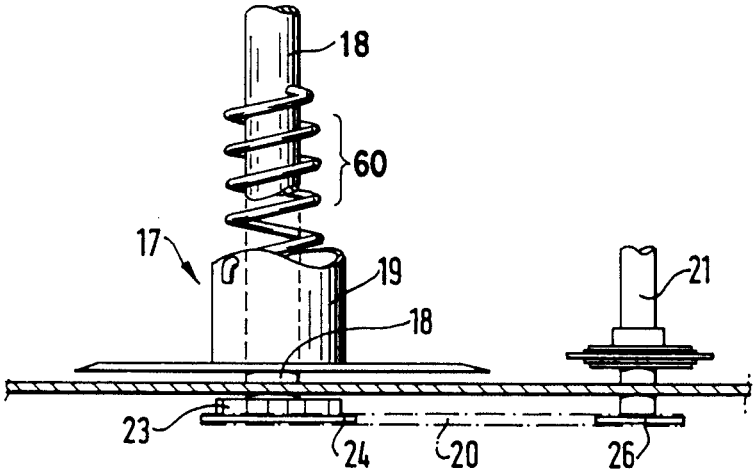
FIG. 3 is a partial side elevational view of the tensioning means.

FIGS. 2 and 3 of the drawings illustrate in more detail the way in which the shutter curtain 10 is housed in the withdrawn condition. The upright roller generally indicated at 17 comprises an inner shaft 18 and an outer tube 19.

The roller 17 is driven by means of a drive chain 20 from a drive shaft 21, driven from an electric motor (not shown in FIGS. 1 and 2). The shaft 21 also drives the laths 11 of the shutter curtain 10 by means of a sprocket drive indicated in chain dotted outline at 22.

As described in our copending British patent application No. 2,172,327, a helical spring 60 is located between the inner shaft 18 and the outer tube 19, one end of the spring being fixed to the inner shaft 18 and the other end to the outer tube 19. The inner shaft 18 carries a ratchet 23 and a drive sprocket 24, connected to the drive chain 20. A pawl 25 connected to the outer tube 19 may be brought into operative engagement with the ratchet 23.

In use, the outer tube 19 and the inner shaft 18 are firstly rotated relative to one an other to induce a tension in the helical spring. This tension is directly proportional to the number of rotations. The ratchet 23 and pawl 25 lock the two against unwinding.

When the desired amount of tension, for example eight or ten rotations, has been given to the spring, the chain 20 is positioned between the sprocket 23 and the drive sprocket 26 of the driven shaft 21, the pawl 25 then beng disengaged.

When the drive motor operates to close the shutter curtain 10, it will be seen that the same rotating drive shaft 21 causes the driven rotation of the shutter curtain 12 through the sprocket 22 and the driven rotation of the inner shaft 18 of the roller through the chain 20 and sprocket 23. The two therefore rotate in unison and the amount of tension in the helical spring remains substantially constant throughout the operation although the inner and outer parts 18 and 19 of the roller are not locked together by the pawl 25, which is has been disengaged from the ratchet.

Thus, the amount of tension in the helical spring remains constant throughout the operation of closing the shutter. When the drive motor is reversed to open the shutter curtain 10, the spring continues to exert a substantially constant tension on the shutter curtain, preventing buckling of the articulated laths 11 and ensuring that the curtain rolls tightly onto the outer tube 19 of the roller.

Because the tension in the spring does not build up excessively as the shutter curtain is unwound from the roller, it will be appreciated that only a modest motor power is required to operate a shutter curtain of considerable length.

Figure 4:
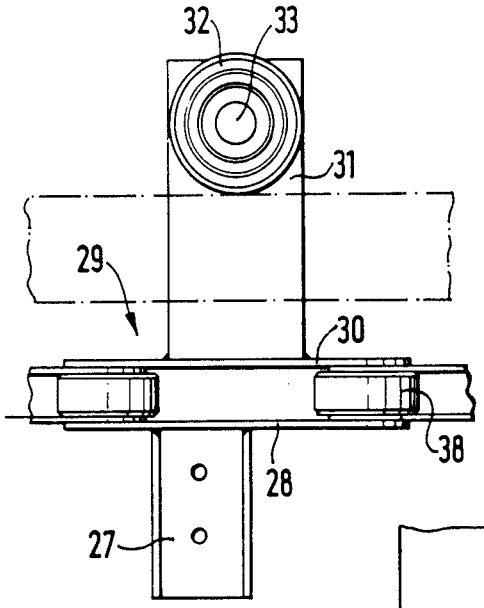
FIG. 4 is a side elevational view of a top suspension of the shutter curtain.
Figure 5:
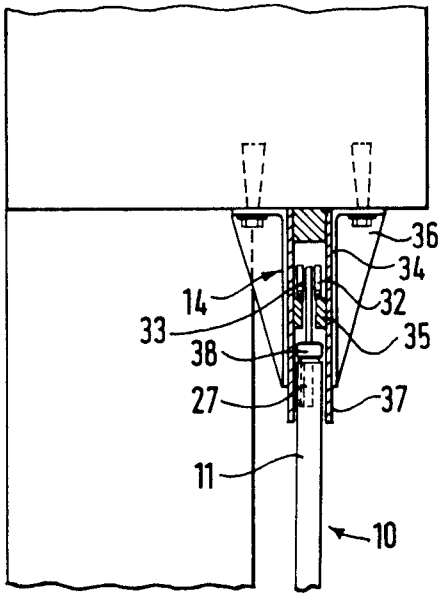
FIG. 5 is an end view corresponding to FIG. 4 but including additional detail of the top track.

Clearly, the weight of a shutter curtain 10, typically of metal laths, is quite substantial and needs to be supported throughout the length of the curtain 11 to ensure smooth running of the shutter curtain from the withdrawn to the extended condition. FIGS. 4 and 5 of the drawings illustrate the top track or guide arrangement of the shutter.

Each shutter lath, which is of generally known type, is secured by bolting, welding or riveting to a depending anchorage 27 which in turn is provided on a link 28 of a horizontally running conveyor type top chain 29. The opposite side link 30 of the chain carriers an upwardly projecting stem 31 having a pair of ball bearing roller wheels 32 rotatably mounted on a transverse pin 33.

In FIG. 5 of the drawings, there is shown the top track 14 of the shutter which includes a pair of inwardly projecting running surfaces 35 which carry the roller wheels 32 of the chain 29. The height of the running surfaces 35 can be adjusted by providing adjustable height brackets 36 for mounting the top track from a suitable support, if necessary using packing or adjustable wedges above the support brackets 36.

The top track also includes a parallel side walls 37 within which articulation rollers 38 of the chain are guided so as to keep the anchorage 27 and hence the lath 11 in an upright position to give smooth running and prevent jamming of the curtain 10.

The lower edge of the curtain 10 may be allowed to run free with the top track 14 providing all the support for the curtain. However, if desired, the lower edge of the curtain may be provided with guide means for location purposes, to prevent the curtain swinging in use, or in order to seal the bottom edge of the curtain against the ground.

This seal may be a rigid seal as required for a security barrier for example, to prevent the curtain from being deliberately displaced or may merely be a seal against bulk air flow, in order to ensure that the curtain offers resistance to fire penetration.

Even where no bottom track is provided, the bottom edge of the curtain 10 will be provided with ball glides such as those shown at 38, which assist in supporting the curtain when it enters the roller housing 12.

Figure 6:
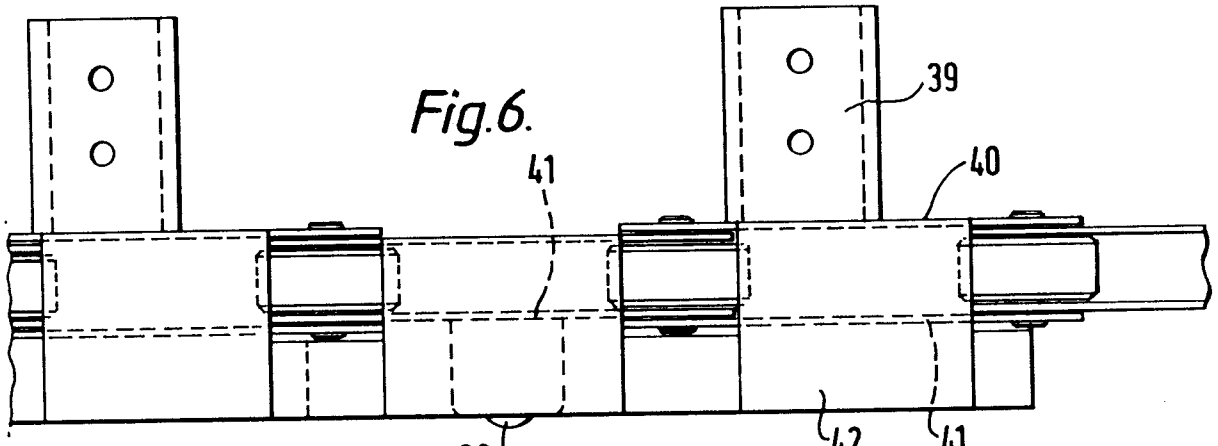
FIG. 6 is a front elevational view of the bottom chain of the shutter curtain.
Figure 7:
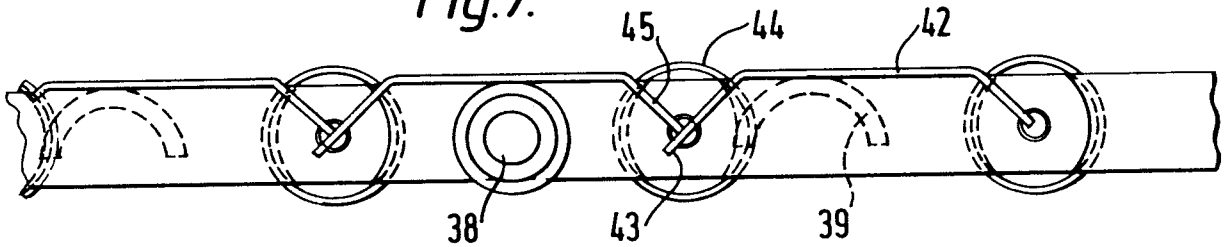
FIG. 7 is an underneath plan view of the bottom chain of FIG. 6.

Turning in more detail to FIGS. 6 and 7 of the drawings, these illustrative the bottom chain provided along the bottom edge of the shutter curtain. The laths 11 are secured by welding, riveting or by fasteners to the upstanding anchorages 39 again provided on side links 40 of a horizontally running conveyor type chain 9. The lower side links 41 of the chain 9 have downwardly depending skirts 42 of the shape shown in FIG. 7 of the drawings. One limb 43 of the skirt extends across the vertical pivotal axis of the chain roller 44 whereas the other limb 45 is cut short so as to cooperate with but not obstruct the limb 43. By this arrangement, articulation of the links of the chain and hence the laths of the conveyor can take place while retaining a fire-resistant seal between the limbs 43 and 45 of the adjacent skirts 42.

The positioning of the ball glides 38 can be seen. These are secured to alternate side links 41 of the conveyor chain.

Where a bottom track is provided, it may have a cover means which is withdrawn only as the curtain passes along the track, to prevent articles from becoming jammed in the bottom track while the shutter curtain is withdrawn.

Since one of the major uses of a roller shutter is as a fire curtain, and since the top track needs to retain its position even in the event of a fire, it is necessary to provide expansion joints for the top track. This will prevent the top track from buckling excessively in the event of a fire. Without such a precaution, the shutter might jam before it had been fully closed or might not be capable of being opened again after a fire had occurred.

Figure 8:
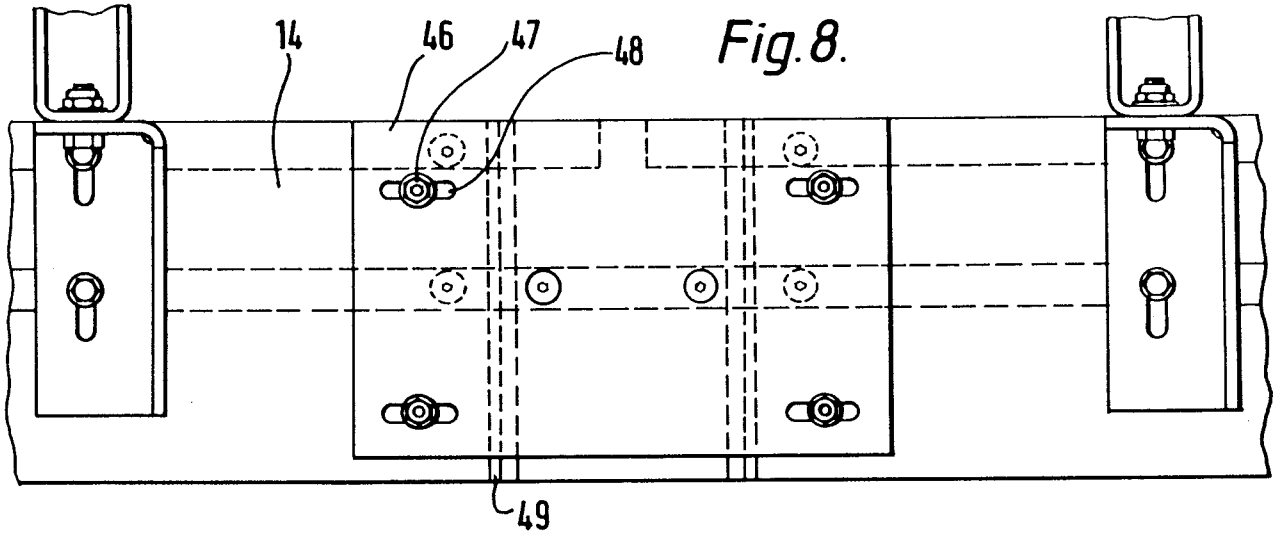
FIG. 8 is a side elevational view of an expansion joint of a top track.
Figure 9:
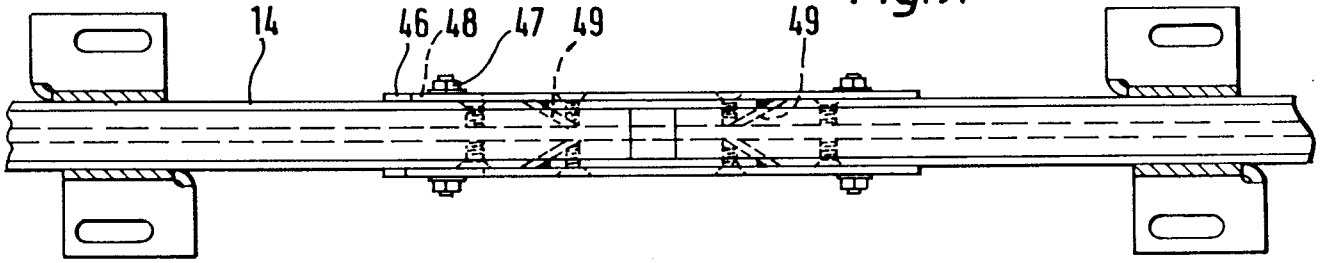
FIG. 9 is a central sectional view of the joint of FIG. 8.

In FIGS. 8 and 9 of the drawings, the top track 14 is illustrated as being provided in sections which are joined together by side plates 46 bolted to the top track sections by bolts 47 in elongate slots 48. A gap 49 is provided between the main track sections 34, and is partly filled by the expansion plates 46. In the event of a fire, expansion of the track sections 34 does not cause them to buckle since the expansion is taken up in the gap 49 which tends to close up by movement of the bolted connection 47 in the elongate slot 48.

As already referred to, the weight of the shutter curtain 10 will normally be carried in its in use condition by the top track, with possibly some additional support from the glides 38 of the lower curtain edge. However, where the curtain is withdrawn into the housing surrounding the roller, the top track 14 is no longer present to support the weight of the curtain and this is then transferred to the lower edge of the curtain, supported within the housing on the roller assembly. The ball glides 38 take the weight or alternatively some ball glide means can be provided within the housing.

Figure 10:
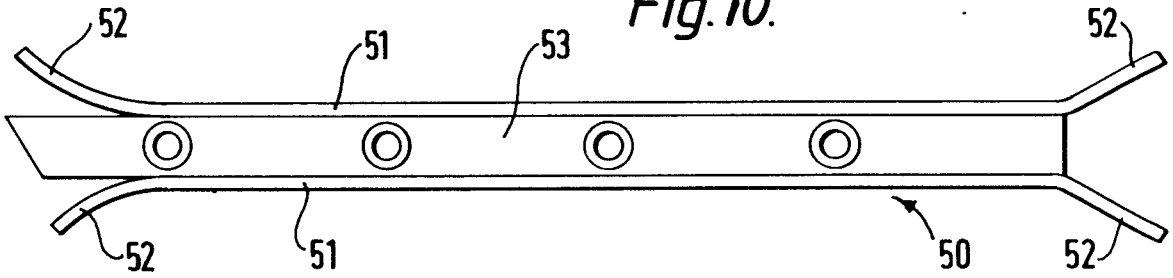
FIG. 10 is a plan view of a lead-in guide for the lower edge of the shutter curtain.
Figure 11:
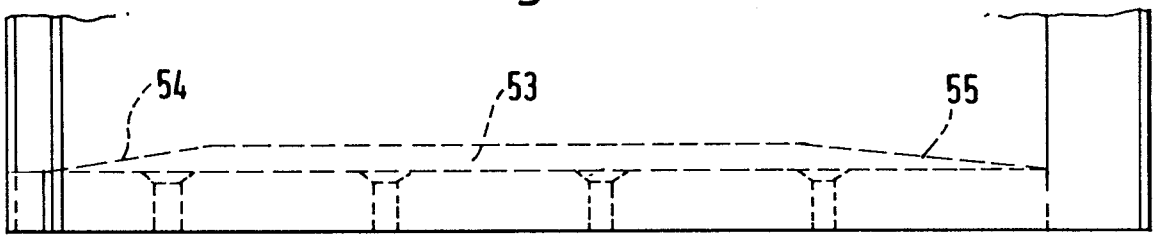
FIG. 11 is a side elevational view of the lead-in guide of FIG. 10.

FIGS. 10 and 11 illustrate a lead-in guide generally indicated at 50 which is provided at the foot of the housing at a position where the curtain 10 leaves the roller 17 to emerge from the housing. The lead-in guide 50 comprises a pair of upstanding side walls 51 which are parallel throughout most of their length but are splayed apart at 52 at each end of the guide. A substantial base support 53 is provided and will be seen to have a ramped upper surface which slopes upwardly at each end as shown at 54 and 55. At the inner part of the housing, the splayed ends 52 are asymmetrical, since the curtain will approach this end of the lead-in from one side as it is unwound from the roller. At this end of the base 53, there is a fairly steep upwardly sloping ramp 54.

At the other end of the base 53, there is a less steeply sloping ramp 55. The side walls are splayed outwardly symmetrically so that the leading end of the curtain is guided into the housing.

Considering the curtain wound on the roller within the roller housing, when the drive means are operated to extend the curtain 10 from the housing 12, the ball glides 38 at the leading end of the curtain ride up the ramp 54 and lift the upper edge of the curtain upwardly so that the ball bearing wheels 32 are momentarily suspended above the running surfaces 35 of the top track 14 as the curtain enters the guide means. Some distance further along the base 53, the ball glides 38 meet the downward ramp 55 and the curtain is gradually lowered so that the ball bearing wheels 32 pick up gradually on the running surfaces 35 of the top track 14. This reduces friction and noise as the successive pairs of ball bearing wheels 32 enter the top track 14. The reverse process happens as the curtain is withdrawn into the roller housing, with the wheels being gradually lifted smoothly off the top track rather than suddenly coming clear of the extreme end of the track.

The invention provides a roller shutter which can be used in situations where roller shutters have previously not been thought practicable, for example for long spans or in irregularly shaped locations. The shutter can be adapted so as to act simply as a closure or as a fire shutter or as a security shutter according to the specific arrangement of the lower track in particular.

I claim:

1. A roller shutter comprising a roller mounted vertically and comprising an inner shaft and an outer tube;

a shutter curtain adapted to be wound on said outer tube in a withdrawn condition horizontal guide means for the curtain;

resilient tensioning means for the curtain, disposed between the inner shaft and the outer tube of the roller;

and drive means having drive engagement with the curtain to drive the curtain along the guide means between the withdrawn condition and an extended condition in which it is unwound from the roller, and also having driving engagement with the inner shaft, the shutter curtain and inner shaft being simultaneously driven so as to retain the tension of said resilient tensioning means substantially constant irrespective of the degree of opening or closing of the curtain.

2. A roller shutter according to claim 1 wherein the resilient tensioning means are provided with releasable locking means whereby they can be pre-tensioned by rotation of the outer tube relative to the inner shaft, prior to engagement of the drive means with the inner shaft.

3. A roller shutter according to claim 1 wherein the guide means comprise a top guide track adapted to support the weight of the curtain in the extended condition.

4. A roller shutter according to claim 3 wherein the top guide track is substantially greater in length than the height of the vertical roller.

5. A roller shutter according to claim 3 wherein the guide track is non-linear.

6. A roller shutter according to claim 3 wherein the guide has expansion joints.

7. A roller shutter according to claim 6 wherein the curtain is of fire resistant laths.

8. A roller shutter according to claim 3 wherein the curtain includes upper and lower chains, each articulated latch being secured to a link of each of the chains.

9. A roller shutter according to claim 8 wherein the drive means includes a drive wheel directly engaging said upper chain.

10. A roller shutter according to claim 8 wherein the upper chain includes roller wheels, running surfaces are provided within the top guide track and the roller wheels are adapted to locate on said running surfaces to at least partly support the weight of the curtain.

11. A roller shutter according to claim 8 wherein the lower chain includes low friction floor engaging means such as ball glides.

12. A roller shutter according to claim 1 wherein a housing is provided within which the roller and the entire curtain are housed in the withdrawn condition, the housing having a region through which the curtain leaves the roller housing on being unwound, said region being provided with a lead-in guide to ensure that the curtain enters the guide means accurately.

13. A roller shutter according to claim 12 wherein the lead-in guide for the roller edge of the curtain includes a ramp adapted to lift the curtain slightly on entering the lead-in guide.

* * * * *